US012509829B2

(12) United States Patent
Lambert

(10) Patent No.: US 12,509,829 B2
(45) **Date of Patent: *Dec. 30, 2025**

(54) REFLECTIVE ROAD MARKER

(71) Applicant: David E. Lambert, Columbus, OH (US)

(72) Inventor: David E. Lambert, Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/610,012

(22) Filed: Mar. 19, 2024

(65) Prior Publication Data

US 2024/0218618 A1 Jul. 4, 2024

Related U.S. Application Data

(62) Division of application No. 17/186,212, filed on Feb. 26, 2021, now abandoned, which is a division of application No. 16/045,437, filed on Jul. 25, 2018, now Pat. No. 10,968,583.

(60) Provisional application No. 62/537,099, filed on Jul. 26, 2017.

(51) Int. Cl.
*E01F 9/553* (2016.01)

(52) U.S. Cl.
CPC ..... *E01F 9/553* (2016.02)

(58) Field of Classification Search
CPC ..... E01F 9/553
USPC ..... 404/12–16
See application file for complete search history.

(56) References Cited

U.S. PATENT DOCUMENTS 3,975,108 A * 8/1976 Suhr ..... E01F 9/553 404/16
4,208,090 A * 6/1980 Heenan ..... G02B 5/124 359/531
4,634,310 A * 1/1987 Clarke ..... E01F 9/553 404/15
5,277,513 A * 1/1994 Flanagan ..... E01F 9/553 404/16
5,340,231 A * 8/1994 Steere ..... E01F 9/553 404/14
5,454,664 A * 10/1995 Siblik ..... E01F 9/553 404/16
6,102,612 A * 8/2000 Pricone ..... E01F 9/553 404/9
6,234,712 B1 * 5/2001 Flader ..... E01F 9/553 116/63 R
6,461,077 B1 * 10/2002 Siblik ..... E01F 9/635 404/15

(Continued)

FOREIGN PATENT DOCUMENTS

GB 2356881 A * 6/2001 ..... E01F 9/553

*Primary Examiner* — Raymond W Addie
(74) *Attorney, Agent, or Firm* — Ice Miller LLP

(57) ABSTRACT

A road marker disclosed herein includes a single piece of material having a width of approximately three inches or less. The piece includes a top surface, a bottom surface, and a sloped face disposed between the top surface and the bottom surface. The bottom surface is configured to enable the bottom surface to be connected directly to a floor of a channel of a roadway. The road marker further includes a reflector disposed on the sloped face. Another road marker disclosed herein includes a reflecting member including a reflective surface. The road marker also includes a housing configured to support at least a portion of the reflecting member below a surface of a roadway.

14 Claims, 14 Drawing Sheets

(56) References Cited

U.S. PATENT DOCUMENTS

| | | | | |
|---|---|---|---|---|
| 10,968,583 | B2 * | 4/2021 | Lambert | E01F 9/553 |
| 2001/0045675 | A1 * | 11/2001 | Attar | E01F 9/573<br>427/163.1 |
| 2009/0041541 | A1 * | 2/2009 | Lowe | E01F 9/553<br>404/14 |
| 2014/0270941 | A1 * | 9/2014 | Intagliata | E01F 9/553<br>29/527.1 |
| 2019/0234032 | A1 * | 8/2019 | Lowe | E01F 9/553 |
| 2021/0180275 | A1 * | 6/2021 | Lambert | E01F 9/553 |

* cited by examiner

REFLECTIVE ROAD MARKER

CROSS-REFERENCE TO RELATED APPLICATIONS

The present application is a divisional application of U.S. patent application Ser. No. 17/186,212, filed Feb. 26, 2021, which is a divisional application of U.S. patent application Ser. No. 16/045,437, filed Jul. 25, 2018, now U.S. Pat. No. 10,968,583, which application claims priority from Provisional Application No. 62/537,099 filed Jul. 26, 2017, each of which applications is incorporated by reference herein in its entirety.

BACKGROUND

Roadways may include reflective or illuminated markers to improve visibility of road or lane boundaries, crosswalks, or other features of a roadway to assist motorists, bicyclists, and/or pedestrians. Conventional reflective markers may be disposed on or above a surface of the roadway or disposed below a surface of the roadway. A reflective marker that is recessed, or disposed at least partially below the roadway, may not be as visible or reflective as a marker disposed above the roadway surface. Further, a recessed marker may be more vulnerable to damage upon impact, such as by a vehicle, especially when a vehicle's wheel enters a channel in the roadway containing the recessed marker.

Therefore, there exists a need for a reflective road marker having increased visibility and reflectance to improve marking of roadway boundaries, lines, indicators, and other features. Further, there exists a need for a reflective road marker that is configured to withstand and/or be protected from impact and other threats on the roadway.

SUMMARY

An embodiment of a road marker disclosed herein includes a single piece of material having a width of approximately three inches or less. The piece of material includes a top surface, a bottom surface, and a sloped face disposed between the top surface and the bottom surface. The road marker also includes a reflector disposed on the sloped face.

An embodiment of a method disclosed herein includes inserting a portion of a tool within a space between a floor of a channel in a roadway and a portion of a first road marker installed in the channel. The first road marker includes a base adhered directly to the floor of the channel. The base includes a sloped face and a reflector disposed on the sloped face. The embodiment of the method also includes operating the tool to dislodge the first road marker from the channel.

An embodiment of a method disclosed herein includes connecting a bottom surface of a base of a road marker directly to a floor of a channel of a roadway. The base is a single piece of material including a bottom surface and a sloped face, and a reflector is disposed on the sloped face.

An embodiment of a road marker disclosed herein includes a reflecting member including a reflective surface. The road marker also includes a housing configured to support at least a portion of the reflecting member below a surface of a roadway. The housing includes a first side wall having a first side wall height configured to position the reflecting member below a surface of a roadway, a second side wall having a second side wall height substantially equal to the first side wall height, and a housing lower portion having a housing lower portion width less than approximately 4 inches.

BRIEF DESCRIPTION OF THE FIGURES

The embodiments described herein and other features, advantages, and disclosures contained herein, and the manner of attaining them, will be better understood from the following description in conjunction with the accompanying drawing figures, in which like reference numerals identify like elements, and wherein.

DETAILED DESCRIPTION

In the following detailed description of embodiments of the present disclosure, reference is made to the accompanying drawings that form a part hereof, and in which is shown by way of illustration, and not by way of limitation, such specific embodiments. It is to be understood that other embodiments may be utilized and that changes may be made without departing from the spirit and scope of the present disclosure.

Figure 1A:
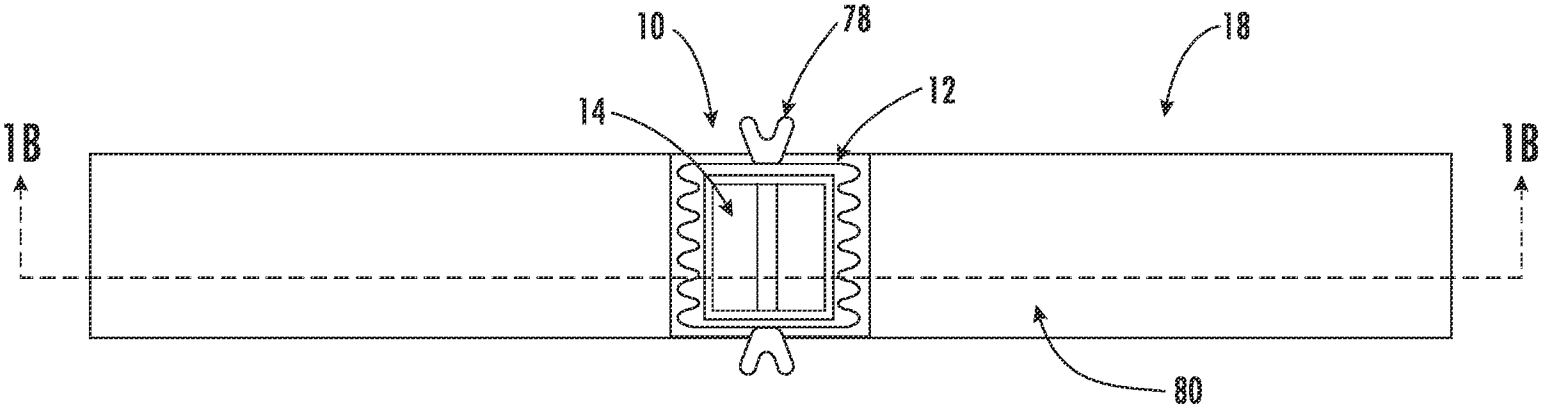
FIG. 1A is a top plan view of an embodiment of a roadway marker disclosed herein.
Figure 1B:
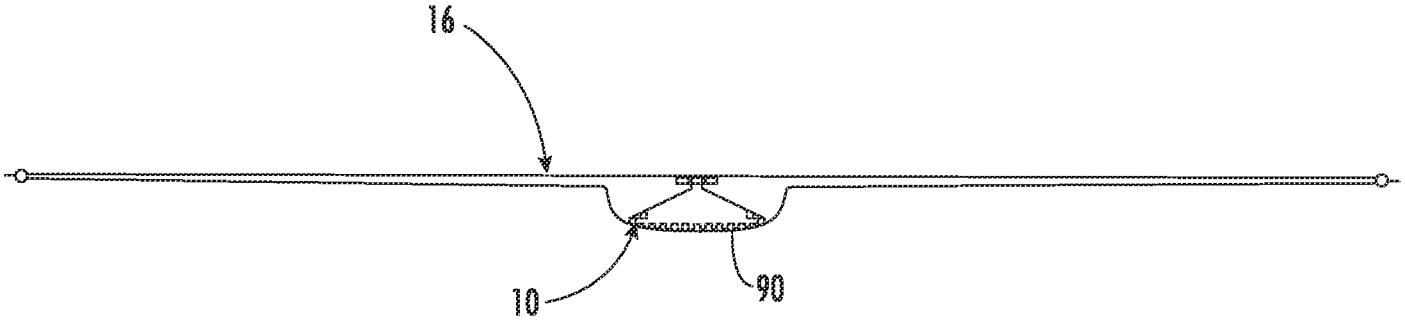
FIG. 1B is a cross sectional elevation view of the roadway marker of FIG. 1A disposed in a channel of a roadway.

Referring now to FIGS. 1A and 1B, an embodiment of a road marker 10 is provided. The road marker 10 is configured to be positioned at least partially below a surface 16 of a roadway 18 in the embodiment illustrated in FIGS. 1A and 1B. The road marker 10 includes a reflecting member 14. In the illustrated embodiment, the reflecting member 14 is positioned below the surface 16 of the roadway 18 in a channel 80. In additional embodiments not illustrated, the road marker 10 and/or the reflecting member 14 is positioned at least partially above the surface 16 of the roadway 18. In some embodiments, the road marker 10 is secured to a curved or concave portion of a floor 90 of the channel 80. The road marker 10 of the present embodiments may be utilized in any road. The term "road" or "roadway" as used herein includes any highway, street, path, runway, shoulder, or other location utilized for vehicles and/or pedestrians. The road marker 10 of some embodiments may include one or more electronic components or devices, such as for use as lighting, for power harvesting, storage, and/or delivery, for communication with individuals, vehicles, outside receivers, and/or other markers, for sensing and/or detection, for identification, and/or for geolocation to name non-limiting examples.

Figure 2:
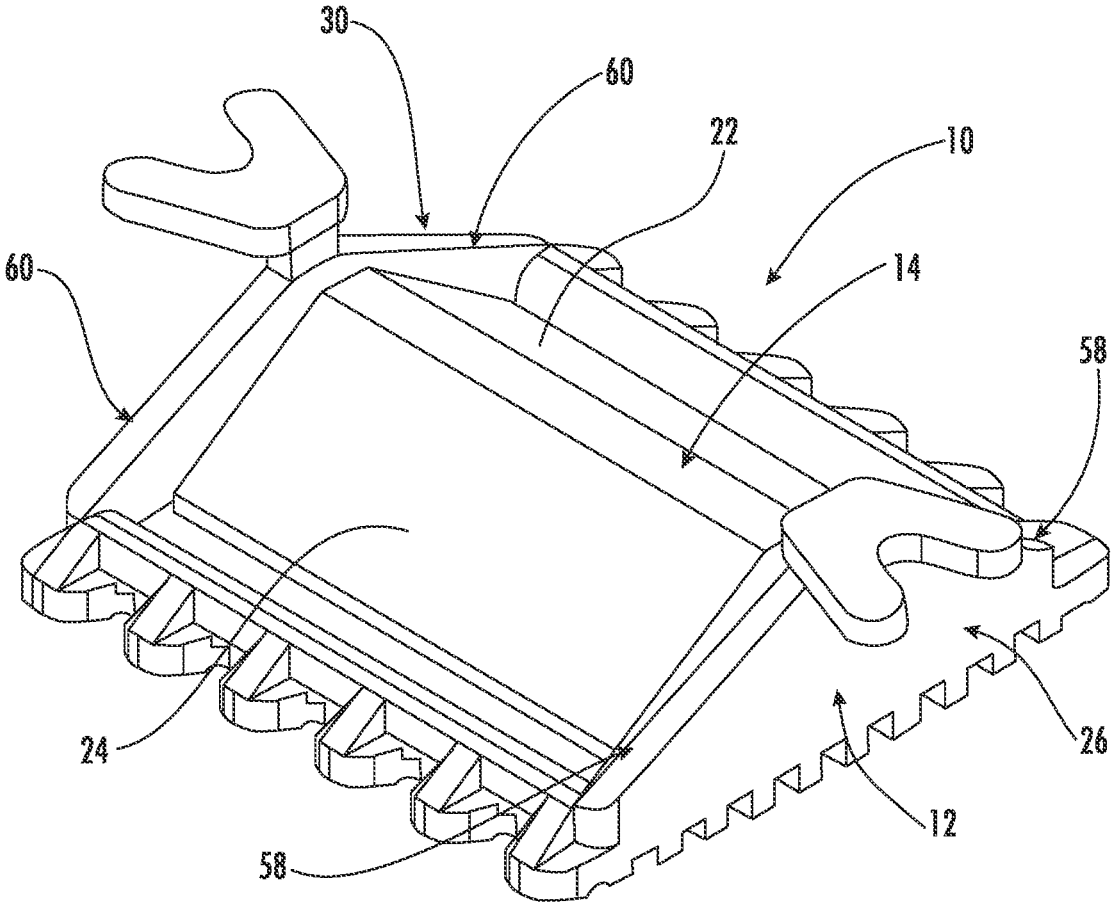
FIG. 2 is a top perspective view of the roadway marker of FIGS. 1A-1B.
Figure 3:
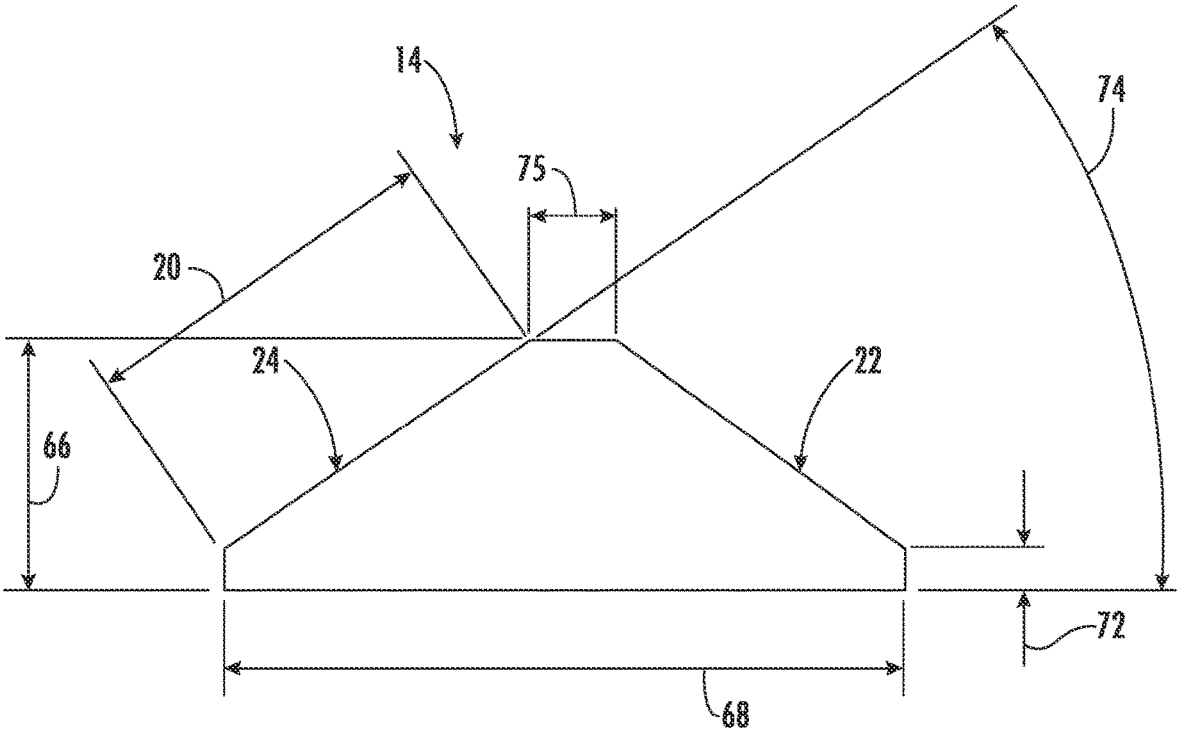
FIG. 3 is a side elevation view of an embodiment of a reflecting member of the roadway marker of FIGS. 1A-2.

As illustrated in FIG. 2, the road marker 10 includes a housing 12 and a reflecting member 14. Referring now to FIG. 3 with continuing reference to FIG. 2, the reflecting member 14 includes at least one reflective surface 22, 24. The reflecting member 14 includes a first reflecting surface 22 and a second reflecting surface 24 in the illustrated embodiment. The reflecting member 14 of particular embodiments comprises one or more reflective lenses to reflect light and mark or indicate one or more roadway lines, boundaries, or other features or aspects. The reflecting member 14 may include a white, red, amber, or any other color reflector. The reflecting member 14 may be made from plastic, metal, ceramic, elastomer, thermoplastic paint, or any other material or combination of materials. The reflecting member 14 may be or may include a lens, sheeting, or other structure that enhances its visibility, such as by retroreflecting headlights of a vehicle in one non-limiting example.

In the embodiment illustrated in FIG. 3, the first reflecting surface 22 and/or the second reflecting surface 24 each has a reflective surface area 20 of at least approximately two square inches. The first reflecting surface 22 and/or the second reflecting surface 24 each has a reflective surface area 20 of between approximately 1 square inch and approximately 9 square inches in an embodiment, between approximately 1.5 square inches and approximately 6 square inches in an embodiment, and between approximately 2 square inches and approximately 4 square inches in an embodiment. The first reflecting surface 22 and the second reflecting surface 24 each have a reflective surface area 20 of approximately 2.37 inches in the illustrated embodiment. The first reflecting surface 22 and/or the second reflecting surface 24 are positioned at a reflecting surface angle 74 of between approximately 10 degrees and approximately 60 degrees in an embodiment, between approximately 20 degrees and approximately 50 degrees in an embodiment, and between approximately 30 degrees and approximately 40 degrees in an embodiment. In the illustrated embodiment, the reflecting surface angle 74 is approximately 35 degrees. The reflecting member 14 has a reflecting member height 66 of at least approximately 0.25 inches in an embodiment, at least approximately 0.50 inches in an embodiment, and at least approximately 0.75 inches in an embodiment. The reflecting member 14 of the illustrated embodiment has a reflecting member height 66 of approximately 0.8 inches. The reflecting member 14 has a reflecting member length 68 of at least approximately 2 inches in an embodiment, at least approximately 2.5 inches in an embodiment, and at least approximately 2.75 inches in an embodiment. The reflecting member length 68 is approximately 2.84 inches in the illustrated embodiment. The reflecting member 14 includes a lower portion height 72 of approximately 0.15 inches and an upper length 75 of approximately 1.00 inches in the illustrated embodiment.

Figure 4:
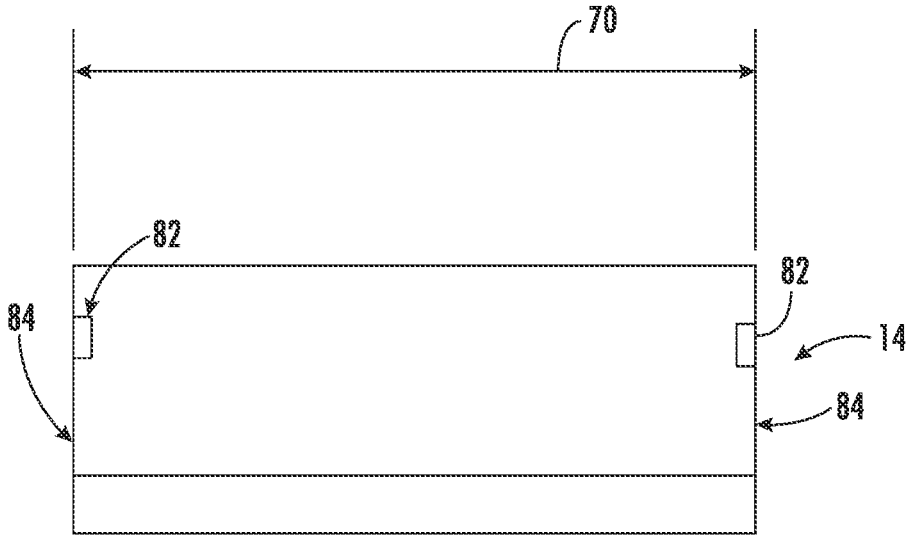
FIG. 4 is a front elevation view of the reflecting member of the roadway marker of FIGS. 1A-3.

Referring now to FIG. 4, the reflecting member 14 has a reflecting member width 70 of between approximately 1.50 inches and approximately 4 inches in an embodiment, between approximately 1.75 inches and approximately 3 inches in an embodiment, and between approximately 2.00 inches and approximately 2.50 inches in an embodiment. The reflecting member width 70 is less than approximately 1.5 inches in an embodiment. The reflecting member width 70 is approximately 2.10 inches in the illustrated embodiment.

The reflecting member 14 includes one or more reflecting member lifting portion(s) 82. The lifting portion(s) 82 of the illustrated embodiment includes one or more notches, and may include any structure capable of being contacted to allow lifting or prying of the reflecting member 14 from the housing 12. In another embodiment not illustrated, the side surface(s) 84 of the reflecting member 14 is/are angled such that an upper width is greater than a lower width to allow lifting or prying of the reflecting member 14 from the housing 12.

Figure 5:
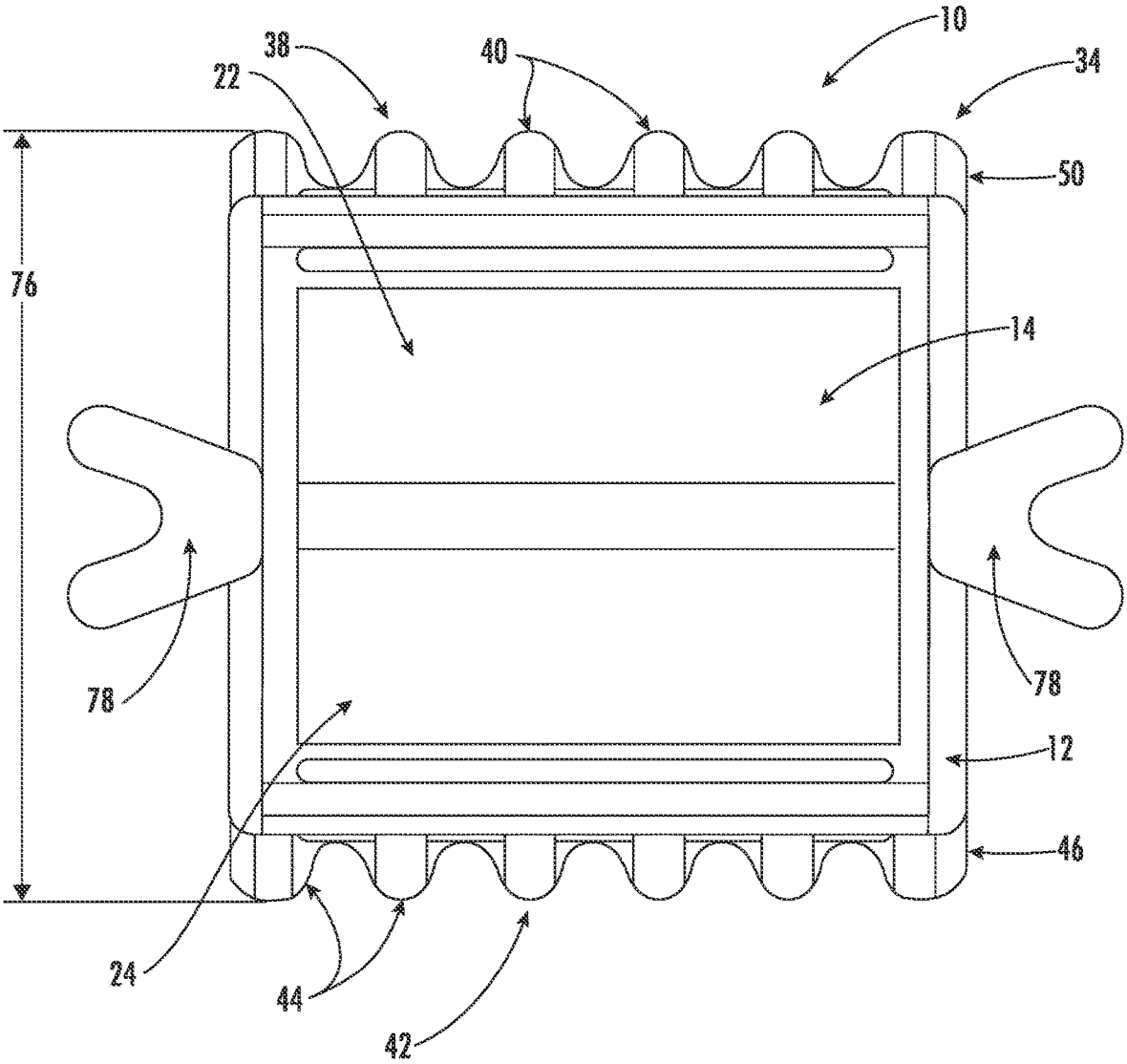
FIG. 5 is a top plan view of the roadway marker of FIGS. 1A-4.

Referring now to FIG. 5, the housing 12 includes a housing lower portion 34 having a housing lower portion length 76 of at least approximately 3 inches in a direction of the channel 80 in an embodiment, at least approximately 3.5 inches in an embodiment, and at least approximately 4 inches in an embodiment. In the illustrated embodiment, the housing lower portion length 76 is approximately 4 inches. The housing 12 further includes one or more tab(s) 78 configured to be positioned on the surface 16 of the roadway 18. In the illustrated embodiment, the one or more tab(s) 78 are frangible. The housing lower portion 34 includes a front lower edge 38 having a plurality of front protrusions 40. The housing lower portion 34 includes a rear lower edge 42 having a plurality of rear protrusions 44. The housing lower portion 34 includes a first side lower edge 46. In some embodiments, the first side lower edge 46 includes a plurality of first side protrusions (not shown). The housing lower portion 34 includes a second side lower edge 50. In some embodiments, the second side lower edge 50 includes a plurality of second side protrusions (not shown). The protrusions described in the present embodiments improve stability of the marker 10 and reinforce the marker 10 in order to prevent unintended removal of the marker 10 from the channel 80.

Figure 6:
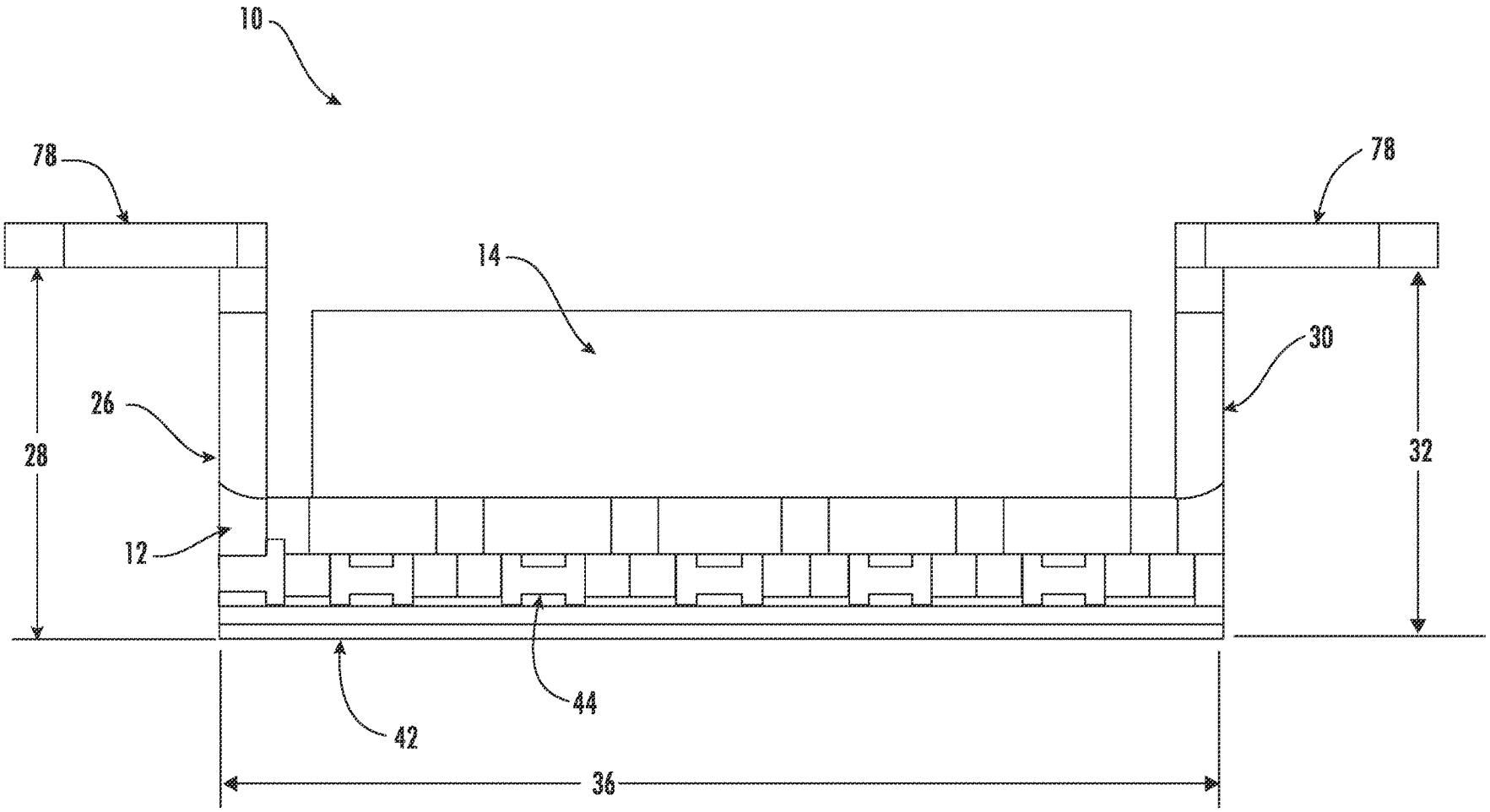
FIG. 6 is a front elevation view of the roadway marker of FIGS. 1A-5.

Referring now to FIG. 6, the housing 12 is configured to support the reflecting member 14. The housing 12 includes a first side wall 26 having a first side wall height 28 configured to position the reflecting member 14 below the surface 16 of the roadway 18. The housing 12 further includes a second side wall 30 having a second side wall height 32 substantially equal to the first side wall height 28. The second side wall height 32 is configured to position the reflecting member 14 below the surface 16 of the roadway 18.

The housing 12 includes a housing lower portion 34 having a housing lower portion width 36 less than approximately 4 inches in the illustrated embodiment. The housing lower portion width 36 is less than approximately 3.5 inches in an embodiment. The housing lower portion width 36 is approximately 3 inches in an embodiment. The housing lower portion width 36 is less than approximately 3 inches in an embodiment. The housing lower portion width 36 is less than approximately 2 inches in an embodiment. The channel 80 is wider than the housing lower portion width 36. In the illustrated embodiment, the channel 80 is approximately 3.25 inches wide to allow for epoxy or another adhesive to be positioned between the channel 80 and the housing 12. The channel 80 is less than approximately 4 inches wide in an embodiment, less than approximately 3.5 inches wide in an embodiment, and less than approximately 3 inches wide in an embodiment.

Figure 7:
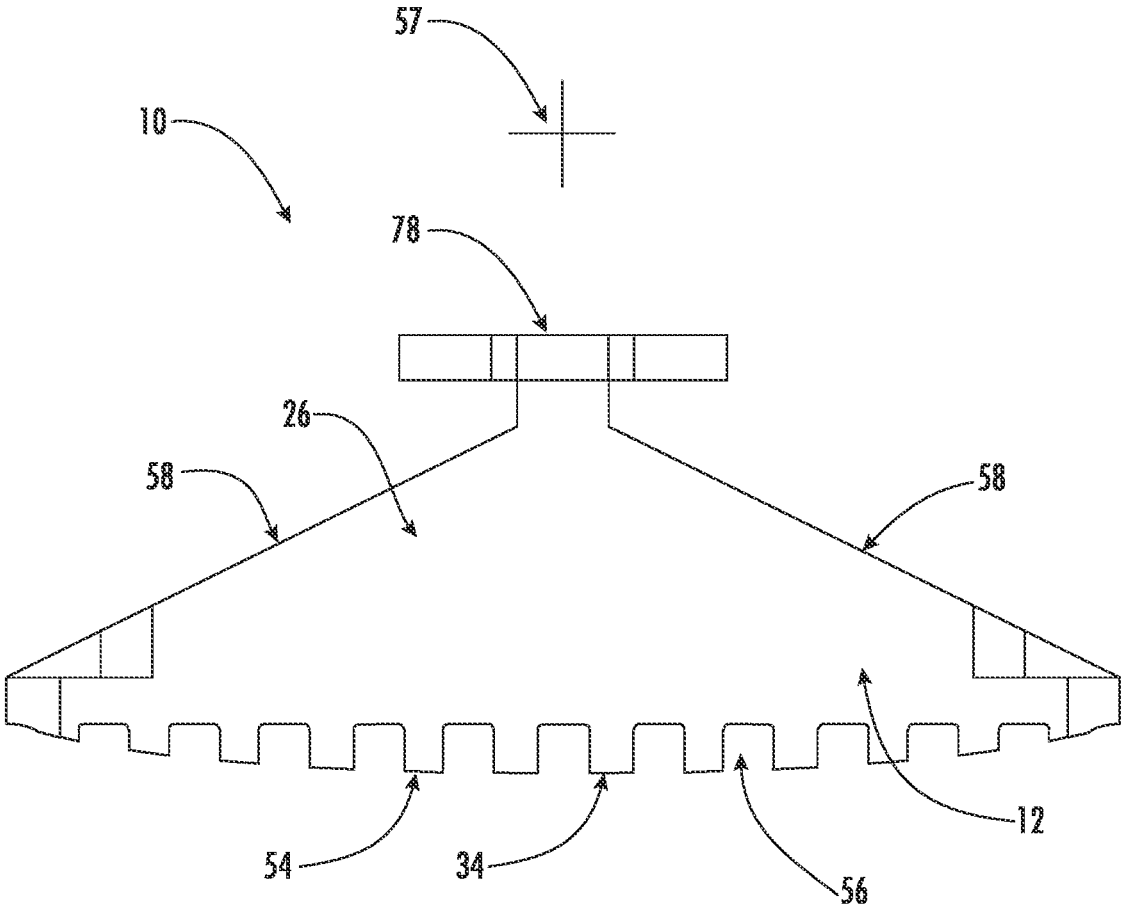
FIG. 7 is a side elevation view of the roadway marker of FIGS. 1A-6.
Figure 8:
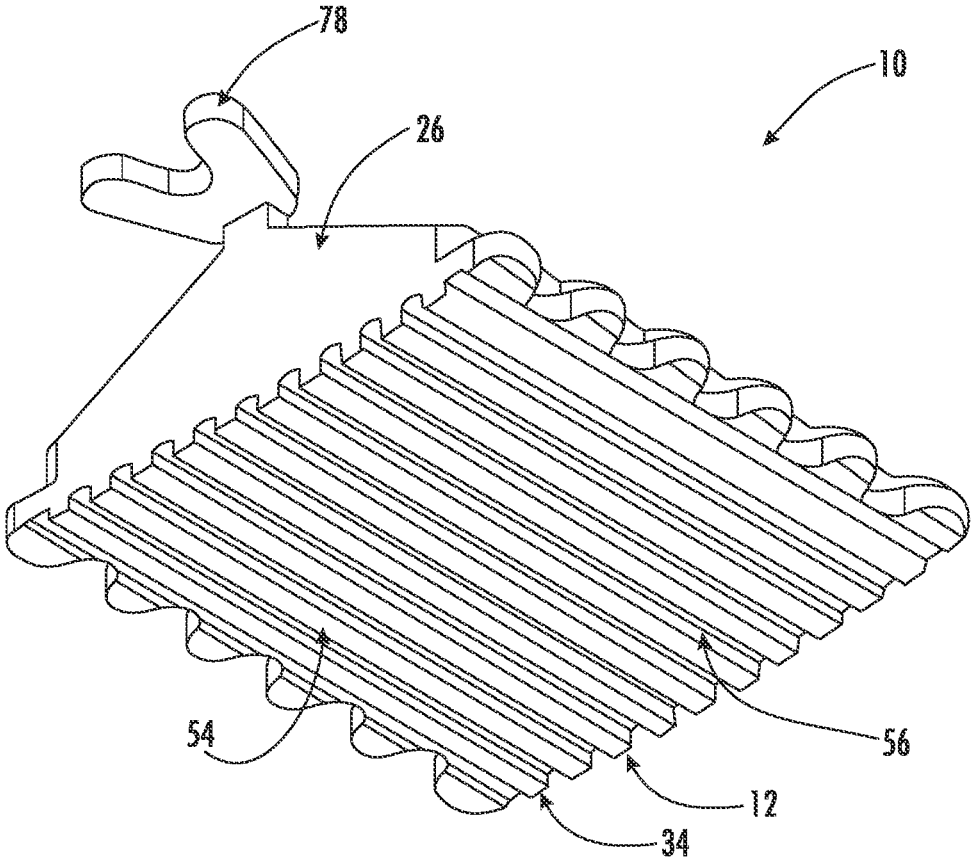
FIG. 8 is a bottom perspective view of the roadway marker of FIGS. 1A-7.

Referring now to an embodiment shown in FIGS. 7-8, the housing lower portion 34 includes a housing lower portion surface 54 having a plurality of channels 56. In the illustrated embodiment, the channels 56 are substantially straight and extend from the first side wall 26 to the second side wall 30. The channels 56 are substantially parallel to each other and substantially perpendicular to the first side wall 26 and the second side wall 30. In other embodiments, the channels 56 are configured in one or more additional and/or alternative ways. In other embodiments, the housing lower portion surface 54 bears other variations on the channels 56, such as, by way of example, and not of limitation, cross-hatching, recesses, and other configurations adapted to facilitate connection of the housing lower portion 34 to the floor 90 of the channel 80. As illustrated in FIG. 7, the housing lower portion surface 54 is curved about a horizontal axis of curvature 57 extending substantially parallel to the channels 56.

Referring again to FIG. 2 with continuing reference to FIG. 7, the first side wall 26 includes one or more first side wall edge(s) 58 parallel or substantially parallel with the first reflecting surface 22 or the second reflecting surface 24. The second side wall 30 includes one or more second side wall edge(s) 60 parallel or substantially parallel with the first reflecting surface 22 or the second reflecting surface 24. Substantially parallel includes parallel within +30 degrees. The first side wall edge(s) 58 and the second side wall edge(s) 60 are positioned, sized, and/or otherwise configured to enhance visibility of the first reflecting surface 22 and/or the second reflecting surface 24.

In some embodiments, the first side wall 26 includes one or more first side wall recess(es) (not shown), and the second side wall 30 (FIG. 2) includes one or more second side wall recess(es) (not shown). The one or more first or second side wall recess(es) of the first and/or second side wall(s) 26, 30 reinforce the road marker 10 by providing enhanced space to accept epoxy or another adhesive. Further, in an embodiment in which the housing 12 is made according to a plastic injection molding operation, the one or more first or second side wall recess(es) improve the ability to remove the housing 12 from the injection cavity after formation.

It will be appreciated that the road marker 10, including the housing 12 and reflecting member 14, provides a roadway marker having increased visibility and reflectance to improve marking of roadway boundaries, lines, indicators, and other features. The housing 12 is configured, shaped, and/or sized to increase visibility of the reflecting member 14. Further, the road marker 10 is positioned subsurface or recessed in the channel 80 such that the marker 10 is configured to withstand and/or be protected from impact by vehicles and other threats on the roadway 18. The channel 80, the road marker 10, and/or the housing 12 are sufficiently narrow to prevent a wheel or other portion of a vehicle from impacting, removing, and/or damaging the housing 12 and/or the reflecting member 14. However, the channel 80, the road marker 10, and/or the housing 12 are sufficiently wide to provide enhanced visibility of the road marker 10 from a significant distance for effective marking of roadway boundaries, lines, indicators, and other features. The configuration of the road marker 10 in the channel 80 extends the useful life of the reflecting member 14 and thereby saves money compared to the frequency with which prior art road markers must be replaced and enhances safety by remaining reflective for a longer period compared to prior art road markers between installation and replacement.

Figure 9:
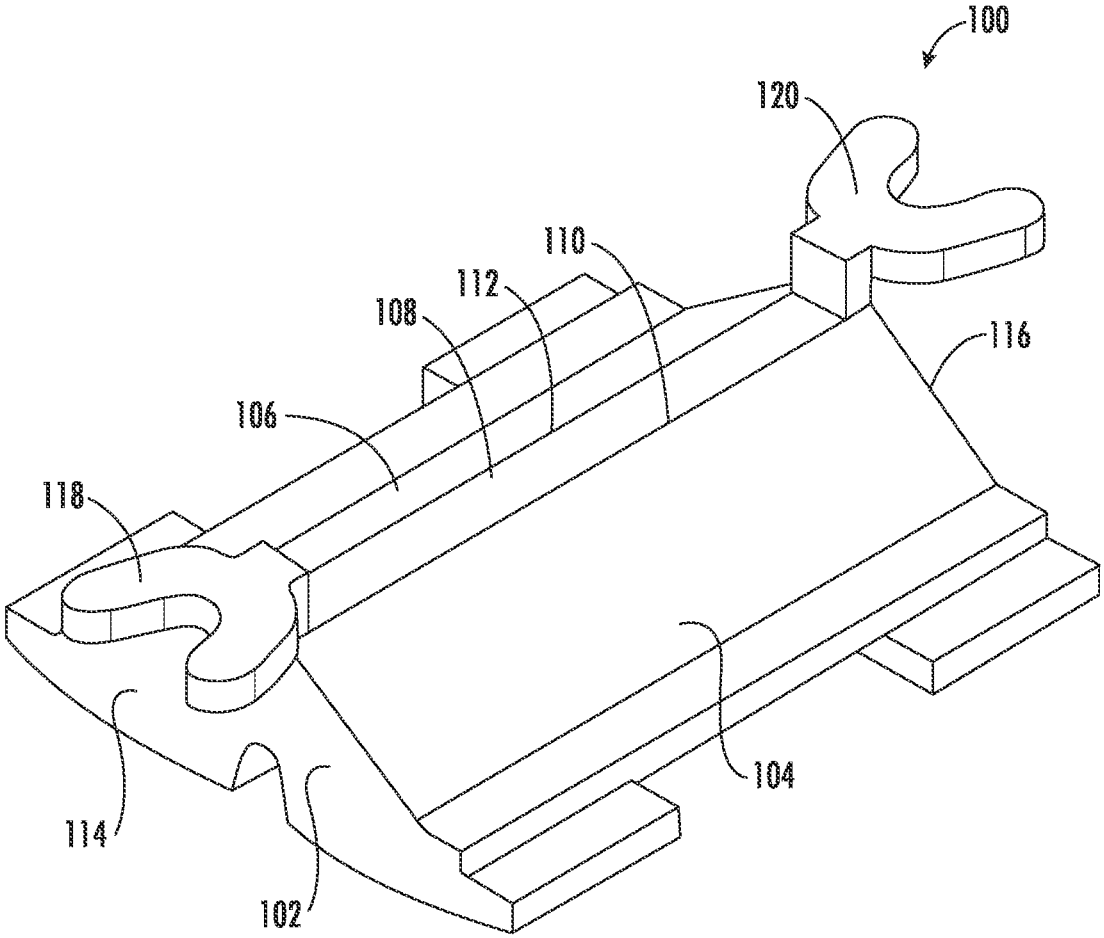
FIG. 9 is a top perspective view of another embodiment of a roadway marker disclosed herein.

FIG. 9 is a top perspective view of another embodiment of a road marker 100 disclosed herein. In the illustrated embodiment, the road marker 100 includes a base 102, a first reflector 104, and a second reflector 106. The base 102 of FIG. 9 is a single piece of material such as any material approved for use by the United States Department of Transportation for use in road markers. As described in greater detail below, the base 102 is to be secured (e.g., adhered) directly to the floor 90 of the channel 80 of the roadway 18. Thus, the road marker 100 of FIG. 9 is configured to be disposed in and installed in the channel 80 without the housing 12 of FIGS. 1-2 and 5-8.

The first reflector 104 and/or the second reflector 106 may be implemented via plastic, metal, ceramic, elastomer, thermoplastic paint, a lens, sheeting, U.S. Department of Transportation standard reflective material, and/or other structure (s), material(s), and/or components. In the illustrated embodiment, the first reflector 104 is disposed on a first sloped face 402 (FIG. 12) of the base 102. The second reflector 106 is disposed on a second sloped face 404 (FIG. 12) of the base 102. A top surface 108 of the base 102 is disposed between the first reflector 104 and the second reflector 106.

In the illustrated embodiment, the first reflector 104 slopes downward from a first side 110 of the top surface 108. The second reflector 106 slopes downward from a second side 112 of the top surface 108. Thus, the first sloped face 402 of the base 102 and the first reflector 104 are disposed between the top surface 108 and a bottom surface 312 (FIG. 12) of the base 102. The second sloped face 404 of the base 102 and the second reflector 106 are also disposed between the top surface 108 and the bottom surface 312 (FIG. 12) of the base 102.

The first side 110 of the top surface 108 is opposite the second side 112 of the top surface 108. Thus, the first reflector 104 and the second reflector 106 face opposing directions. When the road marker 100 is disposed in the channel 80, the first reflector 104 faces a first direction of traffic, and the second reflector 106 faces a second direction of traffic opposite the first direction of traffic. As a result, when the road marker 100 is disposed in the channel 80, only the first reflector 104 may be visible to, for example, drivers driving in the first direction of traffic while only the second reflector 106 may be visible to drivers driving in the second direction of traffic.

In the illustrated embodiment, the first reflector 104 extends from a first side 114 of the base 102 to a second side 116 of the base 102. The first side 114 is opposite the second side 116. The second reflector 106 also extends from the first side 114 to the second side 116 of the base 102. Thus, in some embodiments, a width of the first reflector 104 and/or the second reflector 106 equals or substantially equals a width W (FIG. 10) of the base 102.

In the illustrated embodiment, a first tab 118 extends from the top surface 108 of the base 102 and overhangs the first side 114 of the base 102. A second tab 120 extends from the top surface 108 of the base 102 and overhangs the second side 116 of the base 102. The first tab 118 and/or the second tab 120 facilitate placement of the road marker 100 in the channel 80. For example, an installer may grab the road marker 100 via the first tab 118 and/or the second tab 120 to lower the road marker 100 into the channel 80. The first tab 118 and the second tab 120 are to be disposed above and/or on the roadway 18 when the road marker 100 is disposed in the channel 80 in order to ensure depth of placement of the road marker 100 in the channel 80. In some embodiments, the first tab 118 and/or the second tab 120 are frangible to enable the first tab 118 and/or the second tab 120 to be removed (e.g., broken or sheared off) from the base 102 during or after installation of the road marker 100.

Figure 10:
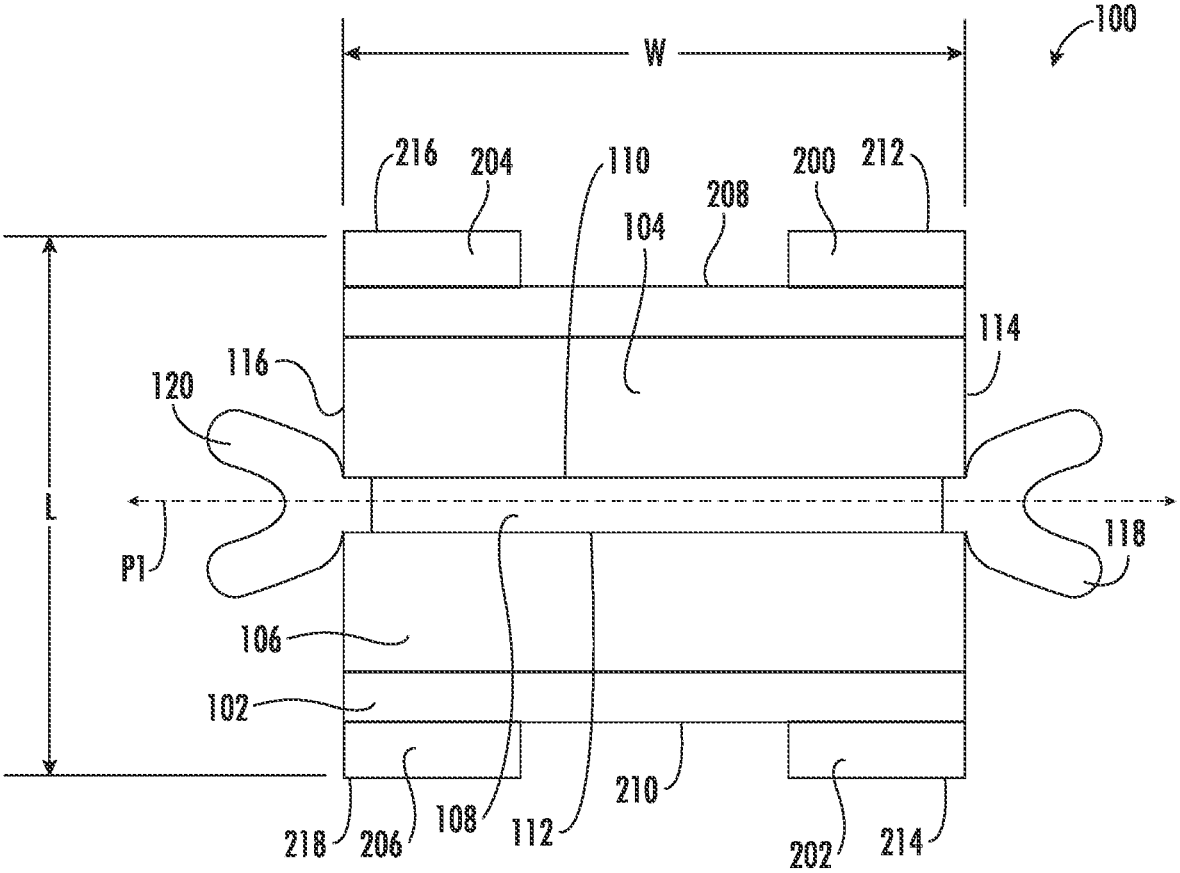
FIG. 10 is a top view of the roadway marker of FIG. 9.

FIG. 10 is a top view of the road marker 100 of FIG. 10. In the illustrated embodiment, the base 102 includes a first lug 200, a second lug 202, a third lug 204, and a fourth lug 206 (collectively "the lugs 200, 202, 204, 206"). The lugs 200, 202, 204, 206 are protrusions or feet in the illustrated embodiment. In the illustrated embodiment, the first lug 200 and the third lug 204 extend from a first end 208 of the base 102 away from a vertical plane P1 that passes through a center of the base 102 and the first side 114 and the second side 116 of the base 102. The second lug 202 and the fourth lug 206 extend from a second end 210 of the base 102 away from the plane P1. In the illustrated embodiment, the first end 208 is opposite the second end 210. In the illustrated embodiment, the first lug 200 and the second lug 202 of FIG. 10 define portions of the first side 114. The third lug 204 and the fourth lug 206 define portions of the second side 116. In other embodiments, the base 102 includes other numbers of lugs (e.g., 1, 2, 3, 5, 6, 7, etc.) and/or the lugs 200, 202, 204, 206 are disposed in other positions on the base 102. In some embodiments, when the road marker 100 is installed in the channel 80, the lugs 200, 202, 204, 206 are submerged and/or covered by adhesive. As a result, the lugs 200, 202, 204, 206 improve stability of the road marker 100 and reinforce the marker 100 to prevent unintended removal of the road marker 100 from the channel 80.

The base 102 has a width W. The width W is a distance from the first side 114 of the base 102 to the second side 116 of the base 102. In some embodiments, the width W is approximately three inches or less. For example, the width W may be approximately two inches to approximately three inches. In some embodiments, the width W is approximately 2.5 inches to approximately three inches. In some embodiments, the width W is approximately 2.75 inches to approximately three inches. In the illustrated embodiment, the width W of the base 102 is approximately 2.88 inches. However, the above-noted values are merely examples, and thus other embodiments may have widths of other values.

By having a width W of approximately three inches or less, the channel 80 may be sufficiently narrow to prevent vehicle tires from entering into the channel 80 and/or contacting the sides 114, 116, the reflective surfaces 104, 106, and/or other portions of the road marker 100. As a result, the road markers 100 disclosed herein are less likely to be broken, loosened, and/or dislodged from the channel by vehicles during use than traditional road markers. Furthermore, even if not broken, loosened, and/or dislodged from the channel 80 by contact with a vehicle tire moving across the channel 80 in which the road marker 100 is disposed, contact between a tire dipping into the channel 80 and a reflective surface 104, 106 mars the reflective surface 104, 106 significantly, thus reducing or eliminating the reflective properties of the reflective surface 104, 106. By having a width of approximately three inches or less for the channel 80, there is insufficient room for a vehicle tire to dip into the channel 80 as it passes over, thereby preventing marring of the reflective surface 104, 106. Thus, the road markers 100 disclosed herein have longer useful lives than traditional road markers.

The base 102 of FIG. 10 has a length L. The length L is a distance from a first tip 212 of the first lug 200 to a second tip 214 of the second lug 202 or a distance from a third tip 216 of the third lug 204 to a fourth tip 218 of the fourth lug 206. In some embodiments, the length L is approximately three inches or less. In some embodiments, the length L is approximately two inches to approximately three inches. In some embodiments, the length L is 2.5 inches to three inches. In some embodiments, the length L is approximately 2.75 inches to approximately three inches. In the illustrated embodiment, the length L is approximately 2.5 inches. However, the above-noted values are merely examples, and thus the invention contemplates that other embodiments may have lengths of other values.

Figure 11:
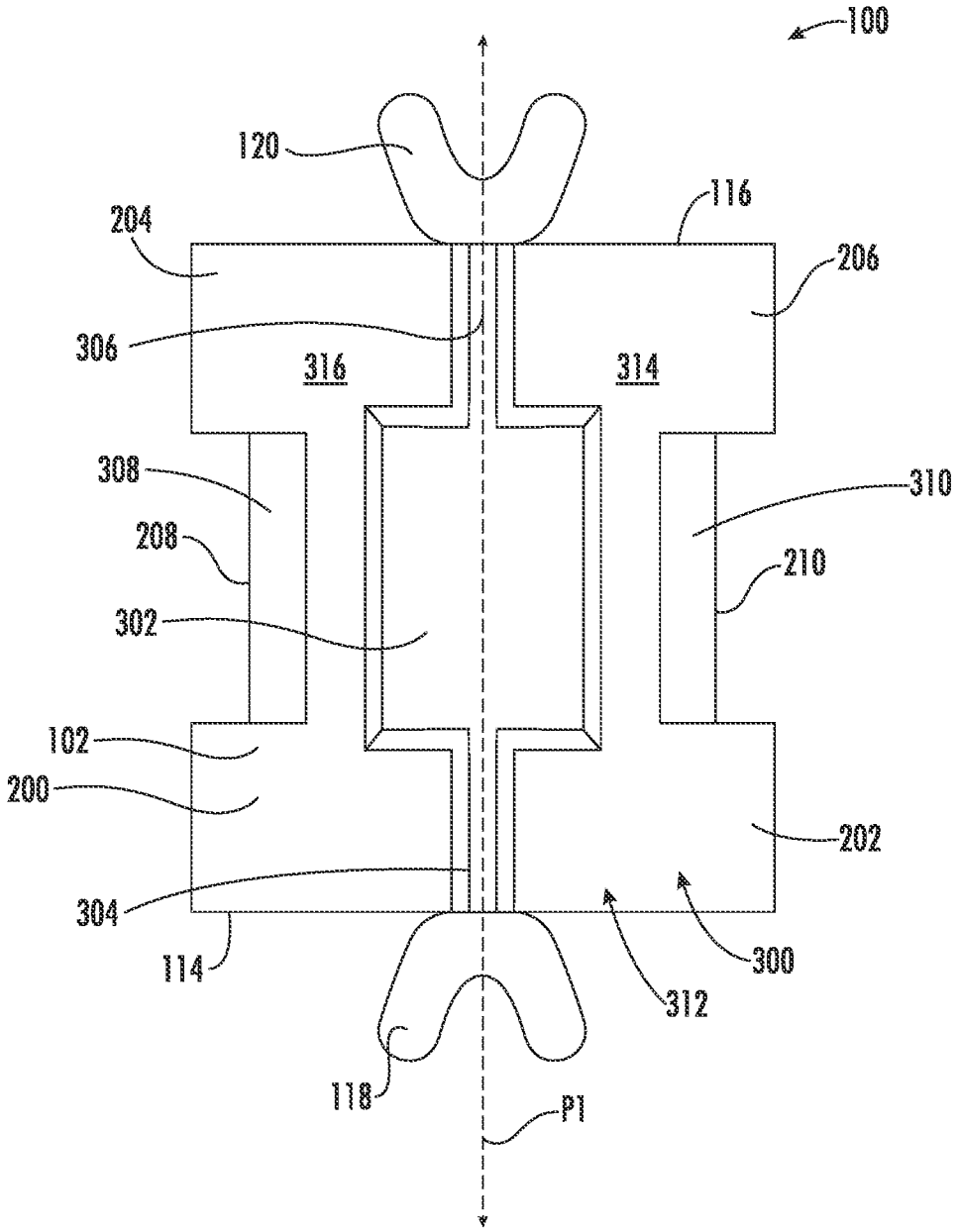
FIG. 11 is a bottom view of the roadway marker of FIGS. 9-10.

FIG. 11 is a bottom view of the road marker 100 of FIGS. 9-10. In the illustrated embodiment, the base 102 includes a bottom side 300. The bottom side 300 includes a central recess or cavity 302. The bottom side 300 also includes a first channel 304 and a second channel 306. The first channel 304 extends from the central recess 302 to the first side 114 of the base 102. The second channel 306 extends from the central recess 302 to the second side 116 of the base 102. In the illustrated embodiment, the plane P1 passes through the first channel 304 and the second channel 306. When the road marker 100 is installed in the channel 80, the base 102 is adhered directly to the floor 90 of the channel 80 via an adhesive such as, by way of example and not of limitation, an exothermic glue. The central recess 302, the first channel 304, and the second channel 306 cooperate to define a flow path extending from the first side 114 to the second side 116 of the base 102 to enable excess adhesive to escape from beneath the base 102 when the road marker 100 is pressed onto the floor 90 of the channel 80 and/or when the adhesive expands while drying and/or solidifying. As a result, the base 102 may lie substantially flush against the floor 90 of the channel 80 after installation.

The bottom side 300 also includes a first notch 308 disposed along the first end 208 of the base 102 and between the first lug 200 and the third lug 204. The bottom side 300 further includes a second notch 310 disposed along the second end 210 of the base 102 and between the second lug 202 and the fourth lug 206. In the illustrated embodiment, the first notch 308 and the second notch 310 are shaped and dimensioned to receive a tip of a tool (e.g., a chipping hammer, a pry bar, etc.). Thus, the first notch 308 and/or the second notch 310 make room for the removal tool to engage the marker-to-roadway-adhesive interface to facilitate removal of the road marker 100 from the channel 80.

In the illustrated embodiment, the bottom side 300 includes a bottom surface 312 including a first section 314 and a second section 316. In the illustrated embodiment, the first section 314 is substantially I-shaped, and the second section 316 is substantially I-shaped. In other embodiments, the first section 314 and/or the second section 316 are other shapes. In some embodiments, the bottom surface 312 has a different number of sections. For example, the bottom surface 312 may include one section, three sections, four sections, five sections, and/or any other number of sections to facilitate securing the base 102 in the channel 80 via, for example, an adhesive. In the illustrated example, the lugs 200, 202, 204, 206 define portions of the bottom surface 312. In some embodiments, the bottom surface 312 includes surface features such as ridges, grooves, bumps, protrusions, knurls, and/or one more additional and/or alternative features to receive adhesive or other securing material to facilitate adhesion of the bottom surface 312 to the floor 90 of the channel 80 via the adhesive or other securing material. In some embodiments, one or more Buna-N (nitrile rubber) pads are disposed on the first section 314 and/or the second section 316 of the bottom side 300 of the base 102 to form a fluid seal around the central recess 302, the first channel 304, and/or the second channel 306 to facilitate removal of the road marker 100 from the channel 80.

Figure 12:
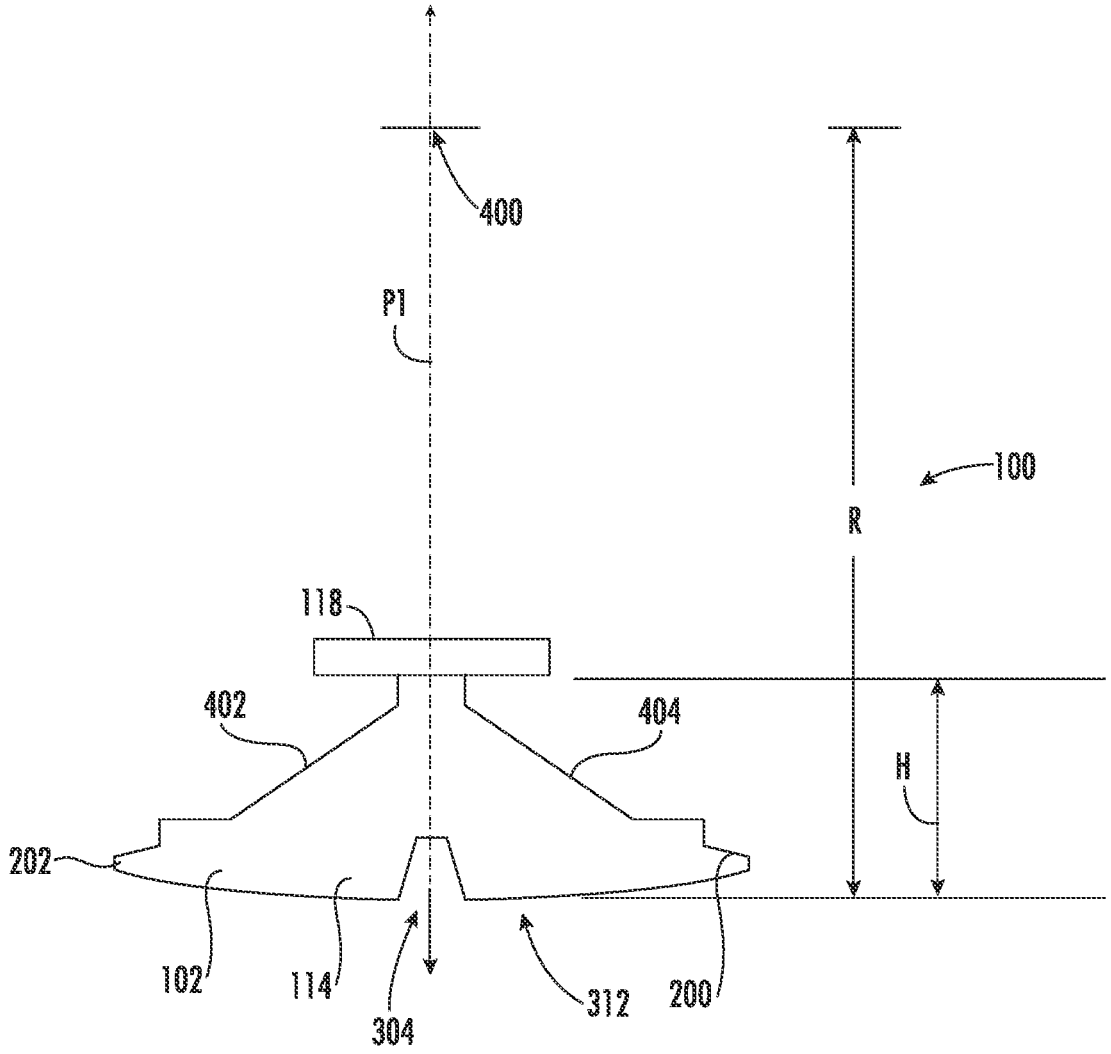
FIG. 12 is a side view of the roadway marker of FIGS. 9-11.

FIG. 12 is a side view of the road marker 100 of FIGS. 9-11. In the illustrated embodiment, the bottom surface 312 is curved about a horizontal axis of curvature 400. The axis of curvature 400 is disposed above the road marker 100 and extends along the central plane P1 (i.e., into the page from the perspective of FIG. 12 and substantially perpendicular to the first and second directions of traffic relative to the road marker 100). Thus, the bottom surface 312 is convex.

In some embodiments, a radius of curvature R of the bottom surface 312 is substantially equal to a radius of curvature of one or more saw blades employed to form the concave portion of the floor 90 of the channel 80. Thus, a curvature of the bottom surface 312 of the base 102 substantially matches or corresponds to a curvature of the concave portion of the floor 90 of the channel 80. Because the base 102 is coupled directly to the floor 90 of the channel 80, and the road marker 100 is to be installed without a housing or cradle, the channel 80 may be narrower than traditional channels for road markers. As a result, building a road employing the inventive road markers 100 disclosed herein may require less saw operation time to form the channels 80, and the road markers may thereby be installed and/or replaced using fewer saw blades and/or the saw blades may be replaced less frequently than when installing or replacing traditional road markers.

In the illustrated embodiment, the base 102 has a height H. The height H is a distance from a lowermost level on the bottom surface 312 to an uppermost level on the top surface 108 of the base 102. In some embodiments, the height H is approximately one inch or less. In some embodiments, the height H is approximately 0.5 inches to approximately 1 inch. In the illustrated embodiment, the height H of the base 102 is approximately 0.88 inches. However, the above-referenced values are merely examples, and the present invention contemplates that other embodiments of the road marker 100 may have heights of other values.

Figure 13:
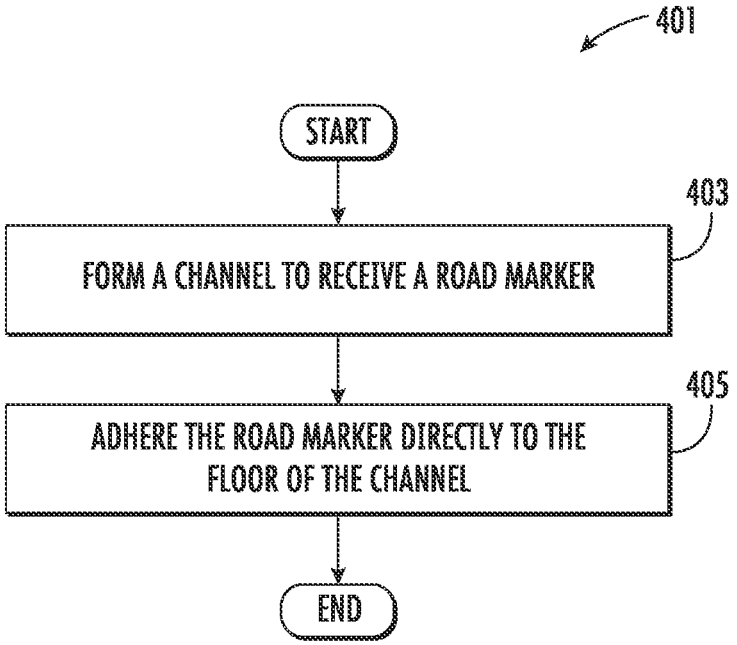
FIG. 13 is a flowchart representative of an embodiment of a method for installing the roadway marker of FIGS. 9-12.

FIG. 13 is a flowchart representative of an embodiment of a method 401 of installing the road marker 100. Although the following method 401 is described with reference to the flowchart of FIG. 13, other methods of installing the road marker 100 may alternatively be used. For example, the order of performance of the blocks may be changed, and/or some of the blocks described may be changed, eliminated, and/or combined.

The illustrated embodiment begins at block 403 by forming the channel 80 to receive the road marker 100. In some embodiments, a saw including one or more saw blades is employed to form the channel 80. In some embodiments, the saw blade is circular and has a radius of curvature substantially equal to a radius of curvature of the bottom surface 312 of the base 102 of the road marker 100. At block 405, the road marker 100 is adhered directly to the floor 90 of the channel 80. By way of example and not of limitation, the bottom surface 312 may be adhered directly to the floor 90 of the channel 80 via an exothermic glue. Thus, the road marker 100 is not supported by a housing or cradle within the channel 80. In some embodiments, when the road marker 100 is pressed into place and/or as a connecting substance is employed to connect the road marker 100 to the floor 90 of the channel 80 is drying and/or solidifying, the connecting substance flows and/or expands from within the central recess 302, into the channels 304, 306 on the bottom side 300 of the base 102, and then out of the channels 304, 306. As a result, the central recess 302 and the channels 304, 306 direct excess connecting substance out from beneath the bottom side 300 of the base 102 to enable the bottom surface 312 to be substantially flush with the floor 90 of the channel 80 upon installation.

Figure 14:
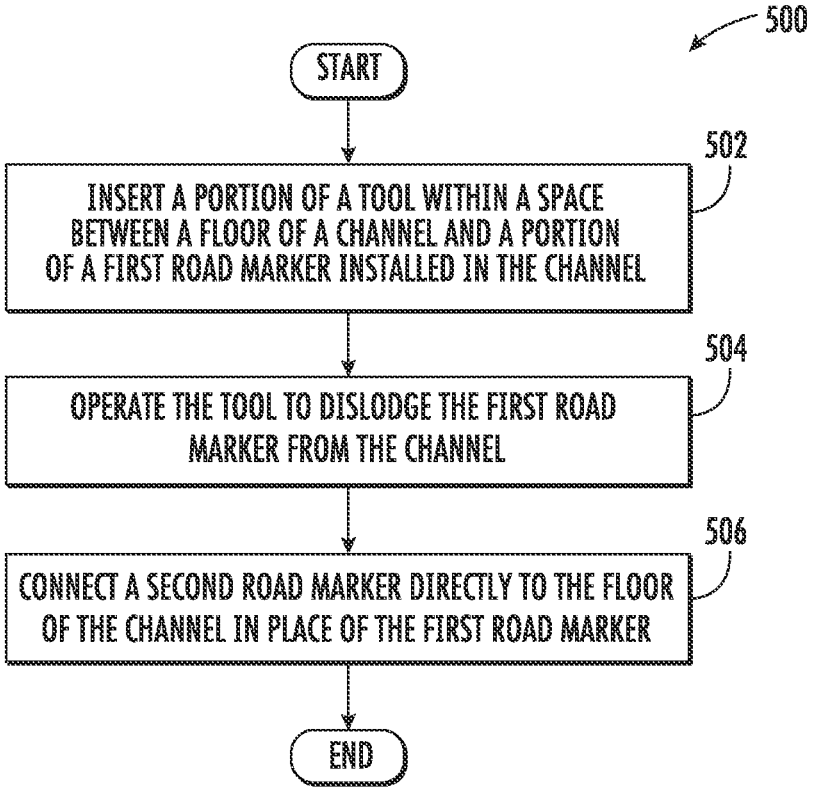
FIG. 14 is a flowchart representative of an embodiment of a method for replacing the roadway marker of FIGS. 9-12.

FIG. 14 is a flowchart representative of an embodiment of a method 500 of replacing the road marker 100. Although the following method 500 is described with reference to the flowchart of FIG. 14, other methods of replacing the road marker 100 may alternatively be used. By way of example and not of limitation, the order of performance of the blocks may be changed, and/or some of the blocks described may be changed, eliminated, and/or combined.

The illustrated embodiment begins at block 502 by inserting a portion of a tool within a space between the floor 90 of the channel 80 and a portion of a first road marker (e.g., the road marker 100) installed in the channel. For example, a tip of a chipping hammer may be inserted into the first notch 308 on the bottom side 300 of the base 102 of the road marker 100. At block 504, the tool is operated to dislodge the first road marker from the channel 80. By way of example and not of limitation, an operator may cause the tip of the chipping hammer to reciprocate to break an adhesive to separate the road marker 100 from the floor 90 of the channel 80. At block 506, a second road marker is connected by any means known in the art directly to the floor 90 of the channel 80 in place of the first road marker. By way of example and not of limitation, a road marker substantially identical to the road marker 100 of FIGS. 9-12 may be adhered to directly to the floor 90 of the channel 80 via an exothermic glue in a location from which the first road marker was dislodged (e.g., the concave portion of the floor 90 of the channel 80).

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. A road marker comprising:

a base having a width of approximately three inches or less, the base including a top surface, a bottom surface, and a sloped face disposed between the top surface and the bottom surface;

a frangible tab overhanging a side of the base; and a reflector disposed on the sloped face;

wherein when the frangible tab is disposed on a roadway surface adjacent a cavity into which the road marker is installed, the reflector is disposed below the roadway surface; and wherein a width of the reflector is substantially equal to the width of the base; and wherein the bottom surface includes a notch.

2. The road marker of claim 1, wherein the base has a width of approximately 2 inches to 3 inches.

3. The road marker of claim 1, wherein the base has a width of approximately 2.5 inches to approximately 3 inches.

4. The road marker of claim 1, wherein the base has a width of approximately 2.75 inches to approximately 3 inches.

5. The road marker of claim 1, wherein the base has a width of approximately 2.88 inches.

6. The road marker of claim 1, wherein the bottom surface is curved about an axis of curvature.

7. The road marker of claim 1, wherein the reflector comprises a first reflector and the sloped face is a first sloped face, the base further comprising a second sloped face, and the road marker further comprising a second reflector disposed on the second sloped face.

8. The road marker of claim 1, wherein a bottom side of the base includes a flow path extending from a first side of the piece of material to a second side of the piece of material, wherein the first side is opposite the second side.

9. The road marker of claim 8, wherein a width of the second reflector is substantially equal to the width of the base.

10. The road marker of claim 1, wherein the notch is shaped and dimensioned to receive a portion of a tool to enable the tool to dislodge the road marker from the floor of the channel.

11. The road marker of claim 1, wherein a bottom side of the base includes a central recess.

12. The road marker of claim 11, wherein the bottom side of the base includes a channel extending from a side of the base to the central recess.

13. The road marker of claim 1, wherein the base includes a first lug extending from a first end of the base.

14. The road marker of claim 13, wherein the first lug defines a portion of the bottom surface.

* * * * *